United States Patent [19]

Hoyrup

[11] 4,435,943

[45] Mar. 13, 1984

[54] METHOD AND APPARATUS FOR FOLDING CARTON FLANGES

[75] Inventor: Sigurd J. Hoyrup, Monta Vista, Calif.

[73] Assignee: Kliklok Corporation, Redwood City, Calif.

[21] Appl. No.: 283,553

[22] Filed: Jul. 15, 1981

[51] Int. Cl.[3] ..... B65B 7/20

[52] U.S. Cl. ..... 53/491; 53/374

[58] Field of Search ..... 53/491, 374, 375, 381 R, 53/480

[56] References Cited

U.S. PATENT DOCUMENTS

| | | | |
|---|---|---|---|
| 1,379,276 | 5/1921 | Moore | 53/374 X |
| 2,263,739 | 11/1941 | Rose | 53/374 |
| 2,425,062 | 8/1947 | Johnson | 53/375 |
| 2,634,566 | 4/1953 | Ohrn | 53/374 |
| 2,669,167 | 2/1954 | Behl | 53/374 X |
| 2,756,553 | 7/1956 | Ferguson et al. | 53/374 X |
| 2,927,411 | 3/1960 | Kerr | 53/374 X |
| 2,974,460 | 3/1961 | Walther et al. . | |
| 2,979,876 | 4/1961 | Galloway | 53/374 |
| 2,987,973 | 6/1961 | Chandler | 53/374 X |
| 2,993,319 | 7/1961 | Gaubert | 53/374 |
| 3,267,637 | 8/1966 | Baker . | |
| 3,485,008 | 12/1969 | Silver | 53/374 X |
| 3,584,432 | 6/1971 | Mayer, Jr. | 53/374 UX |

*Primary Examiner*—Horace M. Culver

*Attorney, Agent, or Firm*—King and Liles

[57] ABSTRACT

An apparatus and method for prebreaking relatively short upstanding flanges formed on the upper edges of a carton including a conveyor system for transporting the cartons and a pair of prebreaking idler rollers engaging the flanges. The prebreaking rollers include a grooved trap for engaging the upper edge of the flanges and side rails are provided to assure against buckling the flanges or the side walls of the carton. A pair of driven rollers aligned with the prebreaking rollers and timed with the passage of the end flanges complete folding of the flanges. The trailing edge of a notch formed in each of the driven rollers folds the trailing end flange.

12 Claims, 8 Drawing Figures

METHOD AND APPARATUS FOR FOLDING CARTON FLANGES

BACKGROUND OF THE INVENTION

This invention generally relates to apparatus and a method for closing cartons, and more particularly, to a flange folding method and apparatus effective for folding down marginal flanges attached to upstanding carton sides to enable secure lid placement on the carton.

Commercially available frozen foods, such as ice cream, are packaged in cartons impervious to water vapor and odors. Such cartons are usually fabricated of plastic coated paperboard preformed to include four sides, a bottom panel and a hinged top cover having depending flanges overlying the top portion of the sides.

A new form of carton for ice cream or the like has a removable paperboard lid. Short vertical flanges are provided along the upper sides of the walls of the carton. When folded down along the margins of the carton mouth, the separate lid covering the mouth engages the flanges to seal the contents.

The process of automatically filling and preparing this new form of carton presents a unique flange folding problem to be solved. Specifically, after the erected cartons are filled with food product, the side flanges must be prebroken and folded down so that the cartons are ready to receive the lids immediately after filling. Especially where the cartons are filled with a liquid product, it is highly desirable to fold the flanges as gently as possible to avoid potential spillage of the product. Furthermore, if the flanges are not properly and fully prebroken, the lid resists proper seating on the carton. When improper seating engagement between the lid and the carton occurs, the process must be interrupted and valuable production time is lost.

Carton folding apparatus are known for use in folding down flanges on a carton. The prior art devices generally require a long series of rollers or plowing blades pressing against the flange as the carton moves along a conveyor. There is little or no control of the fold line of the carton resulting in deleterious outward or inward bowing of the carton sides or flange buckling. The resulting improper flange folding may hinder lid placement on the carton mouth or improper seating engagement, which may result in spillage, carton rejection and/or machine interruption.

SUMMARY OF THE INVENTION

It is accordingly an object of the present invention to provide a flange folding method and apparatus for properly folding carton flanges for prebreaking to facilitate easy lid placement on the carton.

Another object of the invention is to provide a prebreaking apparatus for carton flanges facilitating proper lid and carton seating.

Yet another object is to provide an apparatus for prebreaking flanges capable of minimizing outward bowing of the carton sides, or flange buckling, to effect uniform flange folding.

Still a further object is to provide a method and apparatus for prebreaking the flanges around all four sides of the carton mouth utilizing specially designed rollers positioned along the sides of the carton.

Additional objects, advantages and novel features of the invention will be set forth in detail in part in the description which follows and in part will become apparent to those skilled in the art upon examination of the drawing, or may be learned by practice of the invention. The objects and advantages of the invention may be realized and obtained by means of the instrumentalities and combinations particularly pointed out in the appended claims.

The flange folding apparatus of the present invention is capable of prebreaking short vertical flanges formed along the upper sides of a carton by folding the flanges substantially 90° to a position flush with the carton mouth. The cartons are conveyed along a chain conveyor system to a flange folding station. The cartons are uniformly spaced along the conveyor by lugs connected to drive chains of the conveyor. Prior to entering the flange folding station, a pair of guides located along the sides of the guide path contact the carton side walls for proper alignment of the lateral flanges and support of the side walls during prebreaking.

The prebreaking idler rollers each include an inclined peripheral edge surface and a grooved trap positioned inwardly adjacent the inner edge of the roller. The free edge of the upstanding carton flanges tangentially engages the inclined surface and slides upwardly into trapped, abutting engagement with the grooved trap. Thusly positioned and secured, the inclined surface tangentially contacts both the lateral flanges and the fold lines of the flanges during forward movement of the cartons. The combination of an inclined surface and the grooved trap advantageously minimizes flange buckling and outward bowing of the carton side walls to effect uniform flange prebreaking. A pair of side guide rails extending in parallel relation with the carton along the side walls and a pair of upper guide wings just in front of the prebreaking rollers serve to restrain outward bowing movement.

A pair of driven rollers is positioned downstream in tandem arrangement with the prebreaking idler rollers, and include an operative peripheral folding surface positioned in alignment with the idler rollers. The peripheral surface is basically cylindrical for progressive contact with the prebroken side flanges. The corner ends of the leading end flange are also engaged for folding this flange. A notch is also provided in the peripheral surface of each driven roller to engage and fold down the trailing end flange. The notch is dimensioned and sector shaped to allow the free edge of the trailing end flange to enter the notch. The forwardly directed trailing edge of the notch presses against the ends of the trailing end flange to effect inwardly directed flange folding. The driven rollers are dimensioned and timed with the passage of the carton to allow the trailing end flange to enter the notch for this folding action.

DETAILED DESCRIPTION OF THE DRAWING

DETAILED DESCRIPTION OF THE INVENTION

Figure 1:
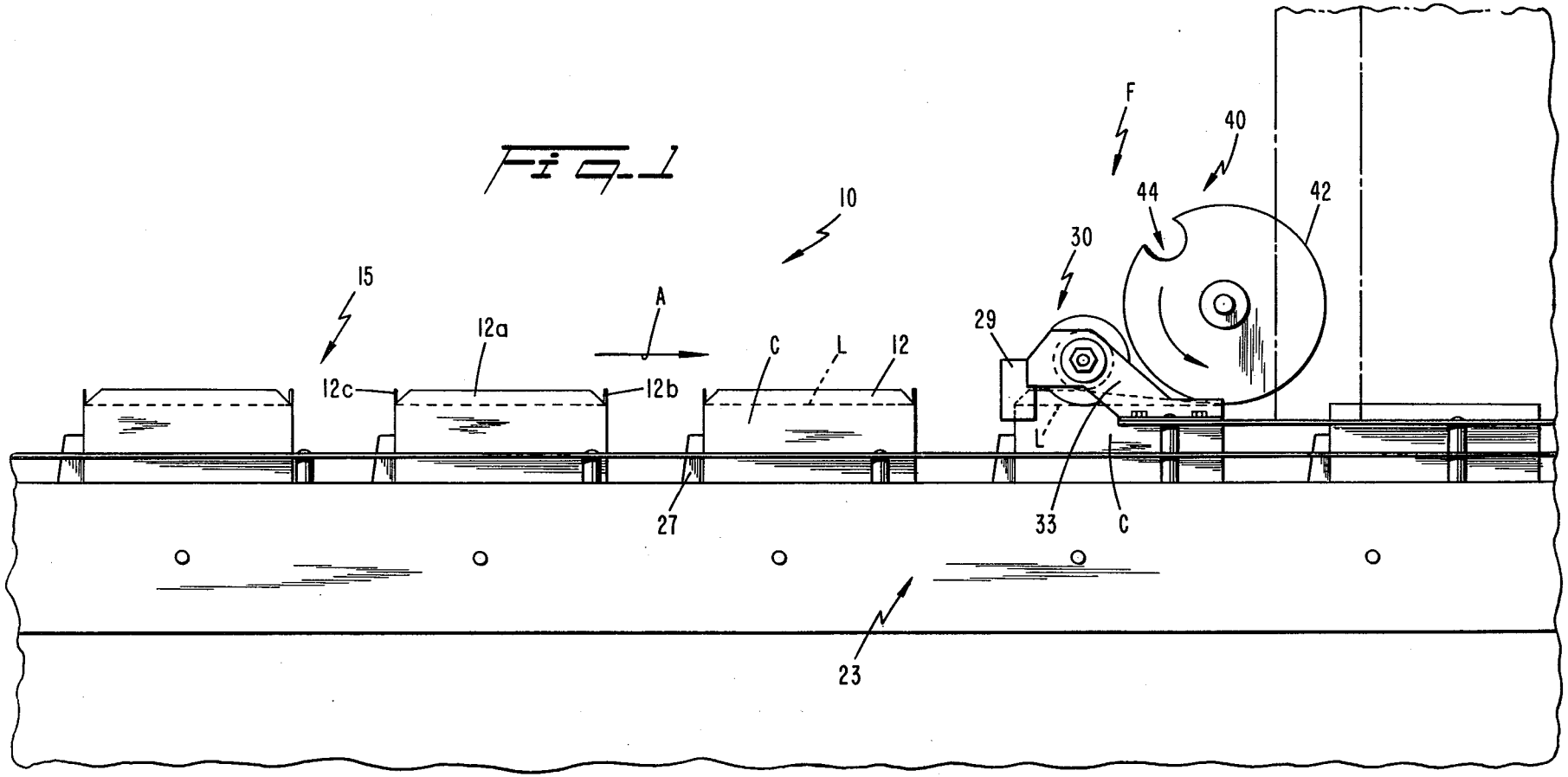
FIG. 1 is a side view of the flange folding apparatus showing a plurality of cartons being conveyed towards a flange folding station.
Figure 2:
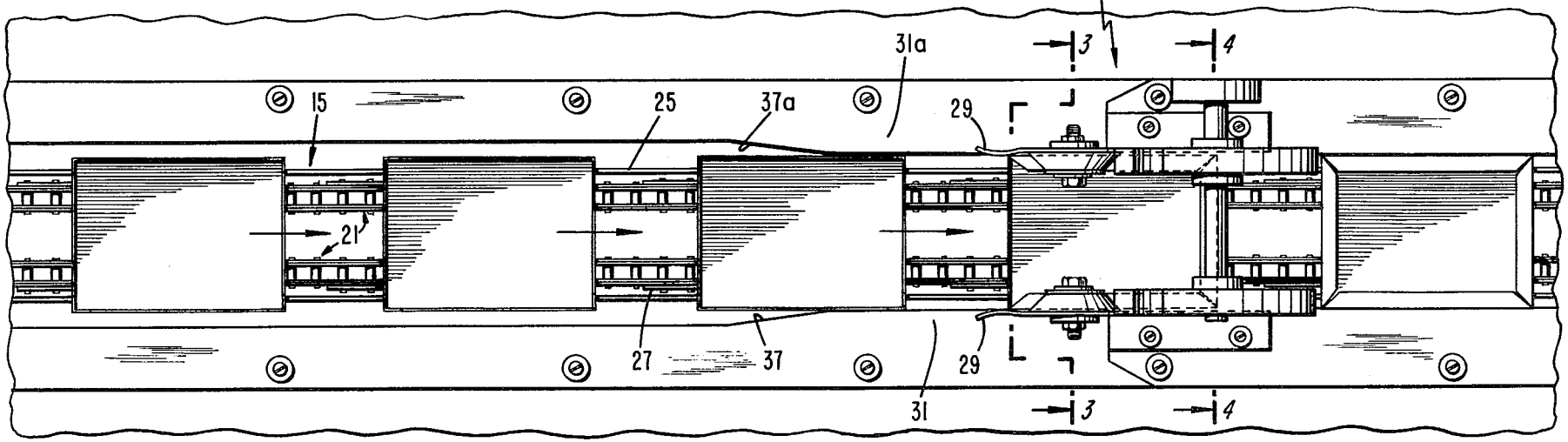
FIG. 2 is a top plan view of the flange folding apparatus shown in FIG. 1, showing alignment and tandem positioning of the prebreaking idler rollers and driven rollers.

Referring to FIGS. 1 and 2, folding apparatus 10 of the invention is shown for use in folding short, upstanding flanges 12 on the side walls of preformed carton C. The cartons are usually plastic coated paperboard, for packaging frozen foods or the like, and include four walls and a bottom panel forming a rectangular body. When folded orthogonally in relation to the carton walls, the flanges partially cover the edges of the carton mouth. Thusly folded, a lid (not shown) can be positively seated in flush engagement on the flanges to cover the carton mouth and fully seal the contents.

Figure 3:
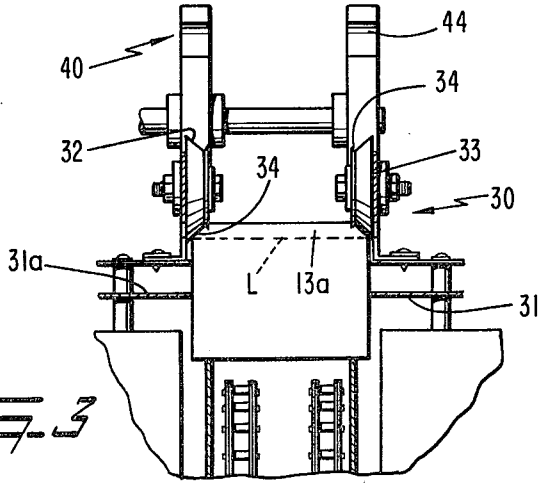
FIG. 3 is a sectional view taken through the line 3—3 of FIG. 2, and shows engagement of the upstanding flanges with the inclined edge surface and grooved trap of the prebreaking idler rollers.

A chain conveyor system, generally designated by the reference numeral 15, is used to transport cartons C from a filling station (not shown) to flange folding station F, where flange folding is carried out in the unique manner set forth below. Chain conveyor system 15, as best shown in FIGS. 2 and 3, includes a double chain drive housed between parallel side frames 23 (see FIG. 4). The double chain drive comprises a pair of endless chains 21 trained around sprockets (not shown) for constant velocity movement in the direction of flange folding station F.

Stationary bottom rails 25 are provided adjacent the outer side of each endless chain 21. The bottom rails 25 project above endless chains 21 to define an even, continuous guide path for supporting cartons C travelling toward folding station F. The upper edges are of rails 25 are smooth and capable of engaging and supporting the bottom panel of carton C in smooth sliding relationship.

Each carton C is driven in uniform spaced relation from each other by a pair of lugs 27 (FIG. 1). Each lug 27 is attached to endless chains 21 in corresponding location with a connecting link plate and projects upwardly above bottom rails 25.

A pair of inwardly tapered side guide wings 29 (FIGS. 1 and 2) are located along the sides of the guide path so as to contact the sides of cartons C entering folding station F. Guide wings 29 serve to orient the flanges 12 for lateral alignment with prebreaking idler rollers 30, as discussed more fully below. In particular, guide wings 29 advantageously serve to maintain flanges 12 in vertical or slightly inward facing position to ensure positive flange engagement with prebreaking idler rollers 30. The wings also assist side guide rails 31, 31*a* (FIGS. 2 and 3) in keeping the side walls of the carton from bowing outwardly, as will be seen more in detail below.

The pair of wings 29 as well as the prebreaking idler rollers 30 are secured to a pair of bracket arms (see FIG. 1). The bracket arms are carried on mounting posts projecting upwardly from side frames 23 (FIG. 1).

As best shown in FIG. 3, each prebreaking idler roller 30 includes an inclined peripheral edge surface 32. An annular grooved trap 34 is located adjacent the inner edge of the inclined edge surface. Inclined edge surface 32 is inwardly tapered at an angle of approximately 45° relative to the central axis of the roller and is both dimensioned and positioned to extend downwardly for tangential engagement with the flange all the way from the free edge to the fold line L. The grooved trap 34 receives the free edge of flange 12 causing a gentle downward folding movement at the fold line L, as follows.

As carton C is advanced toward prebreaking idler rollers 30, initial tangential contact is made between the leading edge of flanges 12 and inclined edge 32. This contact urges the free edge of each flange upwardly along the inclined edge into trapped, abutting relationship with grooved trap 34. The side walls of the carton cannot bow outwardly because of the presence of the guide rails 31, 31*a*. Thusly secured, side flanges 12 and fold line L are forced into tangential contact with inclined edge 32. Progressive forward movement of cartons C on conveyor system 15 allows the inclined edge to gradually press against the entire length of side flanges 12; and in this manner, the flanges are prebroken inwardly along fold line L in a controlled fashion. The side flanges 12 are permanently prebroken to an angle corresponding approximately to the inclination of inclined edge 32 (i.e., approximately 45°).

The feature of providing the inclined edge 32 in combination with grooved trap 34 advantageously serves to minimize flange buckling and outward bowing of the carton walls to effect gentle and uniform flange prebreaking. Further, the grooved trap 34 is operable to pivot the flanges preventing inward bowing of the side walls during contact with the inclined edge, thus assuring a positive prebreaking relationship. In addition, since prebreaking rollers 30 freely rotate during contact with flanges 12, scuffing and possible damage to the flanges is prevented.

As shown in FIG. 2, the pair of side guide members 31, 31*a* are provided with inwardly tapered guide sections 37, 37*a*. Thus, as each carton approaches the folding station F the side walls of the carton are fully supported against outward bowing action. The full action of the trap 34 acting against the flange 12 pushing the fold line L outwardly may be realized giving superior folding action.

Figure 4:
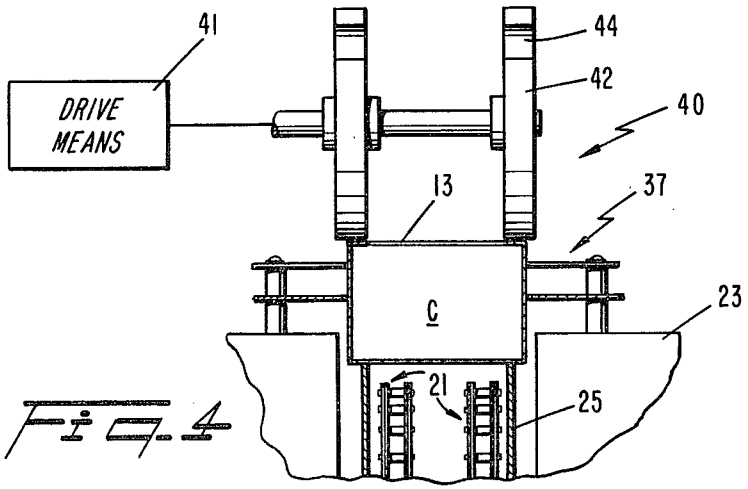
FIG. 4 is a sectional view taken through the line 4—4 of FIG. 2, and shows engagement of the driven rollers to complete flange folding.

To complete folding of flanges 12, a pair of driven rollers 40 are positioned downstream and in tandem arrangement with prebreaking idler rollers 30. As shown in FIGS. 2–4, driven rollers 40 are mounted on a shaft extending transversely above the guide path. Suitable drive means 41 (FIG. 4) is connected to the shaft to drive the rollers 40 at a constant velocity greater than the speed of chain conveyor system 15.

Figure 6:
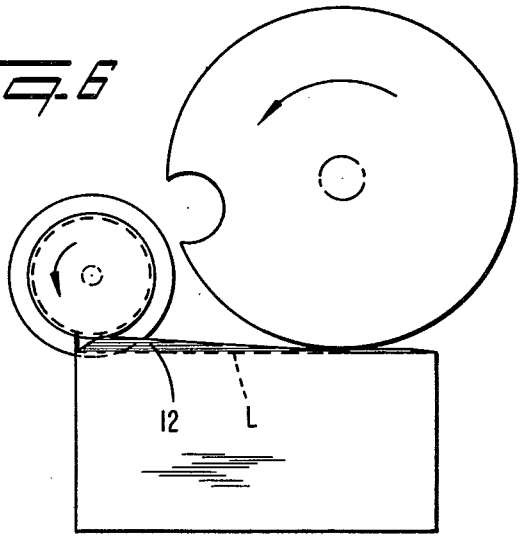
FIGS. 5 and 6 are partial, schematic views of the prebreaking idler roller and driven roller in progressive tangential engagement with the side flanges and leading end flange.
Figure 5:
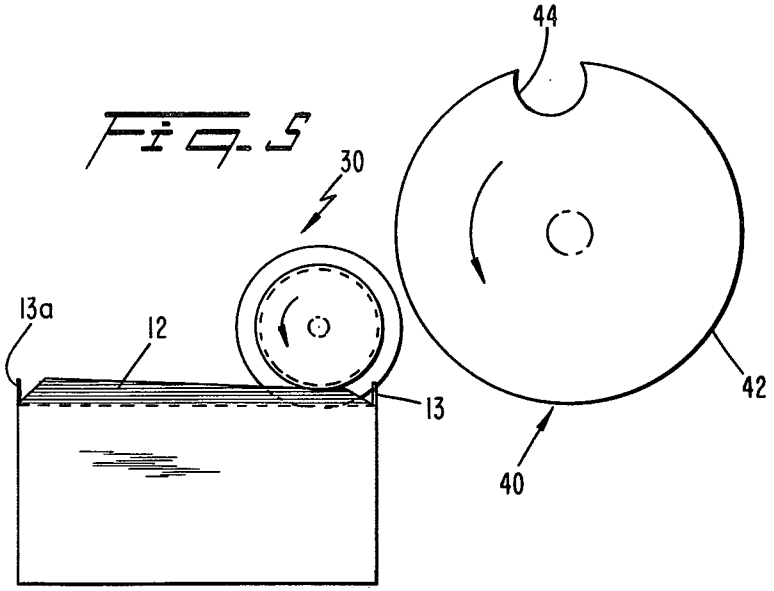

Driven rollers 40 include peripheral edge surface 42 for progressive tangential contact with the side flanges 12, as well as the corners of leading end flange 13 (see FIGS. 4–6). To effect complete folding of the flanges, the point of tangential contact of peripheral edge 42 corresponds to the height of fold lines L, as shown in FIGS. 4 and 6. Gradual contact and folding down of side flanges 12 subsequently occurs during continued forward travel of carton C beneath driven rollers 40 (see FIG. 6).

Figure 8:
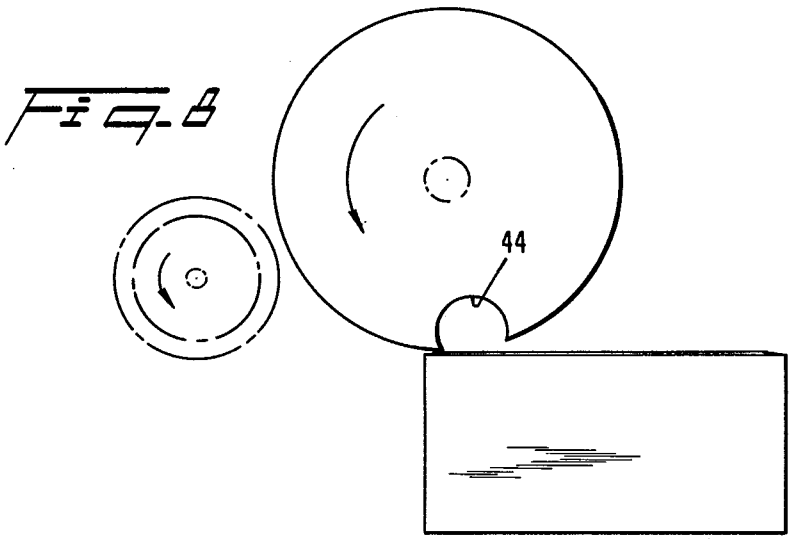
FIG. 8 is a partial, schematic view similar to FIG. 7 showing folding of the trailing end flange by the trailing edge of the notch.
Figure 7:
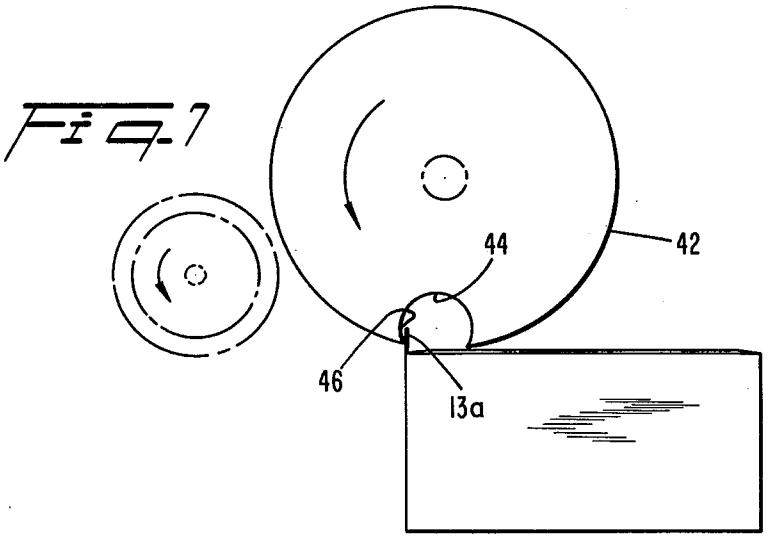
FIG. 7 is a partial, schematic view similar to FIGS. 5 and 6, showing the entrance of the trailing end flange into a notch formed in the driven roller followed by engagement with a trailing edge of the notch.

For the purpose of engaging and folding down trailing end flange 13*a*, a notch 44 is provided in peripheral edge surface 42 of each driven roller 40. As best shown in FIGS. 7 and 8, notches 44 are dimensioned and sector shaped so as to allow the free edge of trailing end flange 13*a* to enter the notch and avoid undesirable outward folding movement. Furthermore, the arcuate extent of notch 44 in the edge surface is sufficient to cause trailing edge 46 of the notch to move forward against, as well as downward against, the flange 13*a* as the roller 40 goes from the FIG. 7 position to the FIG. 8 position. Thus, the forwardly directed trailing edge 46 is capable of pressing forwardly and downwardly against the trailing end flange 13*a*. With this action the flange 13*a* is gently and positively folded down as desired.

Driven rollers 40 are dimensioned and timed with the passage of trailing end flange 13*a* so as to allow the same to enter notch 44 for folding by trailing edge 46. The tangential velocity of drive rollers 40 is slightly greater than the linear velocity of chain conveyor system 15, as discussed above, to allow the folding action. A preliminary folding station (not shown) may be provided for end flanges 13, 13*a* while the carton C is turned at 90° to that shown in FIG. 1. This station may include prebreaking idler rollers and driven folding rollers similar to rollers 30, 40, respectively, and located just upstream of FIG. 1.

The preferred method used to prebreak and fold down flanges 12 is best understood by summarizing the steps involved in directing the flanges and fold lines L into tangential contact with prebreak idler rollers 30 and driven rollers 40. As discussed above, cartons C are fed onto chain conveyor system 15 after passing through a carton filling station. Cartons C slide smoothly along bottom rails 25 toward folding station F driven by lugs 27 engaging the rear carton wall. Flanges 12 are aligned with prebreaking idler rollers 30 by side guides 31, 31*a* and wings 29.

As each carton C passes beneath prebreaking idler rollers 30, the forward edge of the flanges 12 are directed upwardly along inclined edge surface 32 into trapped, abutting relationship with grooved trap 34, where further inward lateral movement is prevented. Engagement with grooved trap 34 positions flanges 12 in tangential contact flush with inclined edge surface 32 (FIG. 3). Prebreaking of flanges 12 occurs during progressive rolling movement beneath the prebreaking rollers 30. After passing beneath prebreaking rollers 30, the flanges 12 are now prebroken to an angle corresponding to the inclination of inclined edge 30, approximately 45°.

The outer corners of leading edge flange 13 engage peripheral edge surface 42 of driven rollers 40. Since the point of tangential contact between the leading edge flange and the driven rollers is located at the same elevation as fold line L, folding of the leading edge flange 13 results. The peripheral edge surface 42 next contacts and completes folding down of the side flanges 12. The trailing edge 46 of notches 44 is operable to contact and fold trailing end flange 13*a* to complete the flange folding process. With the flanges thusly folded, carton C is next conveyed to a lidding station where positive seating of the lid over the carton mouth is assured.

The foregoing description of the preferred embodiments of the invention has been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

I claim:

1. A folding apparatus for prebreaking and folding relatively short upstanding flanges formed on the upper sides of a carton or the like, comprising:

(a) conveying means for moving the carton along a predetermined guide path at a substantially uniform velocity, said carton positioned on the conveying means to define upwardly directed side, leading and trailing end flanges;

(b) first folding means including a grooved trap and inclined edge surface positioned above the guide path for engaging and partially folding down the upwardly directed side flanges of the carton, said grooved trap being positioned adjacent the inclined edge surface to engage and trap the upwardly directed free edge of said side flanges; and (c) second folding means for contacting and completing the folding down of said prebroken flanges, said second folding means being further operable to contact and prebreak the leading end and trailing end flanges.

2. In a folding apparatus for prebreaking and folding upwardly directed side and leading end and trailing end flanges of a carton moving on a conveyor system along a predetermined guide path, the improvement comprising first folding means including an inclined edge surface and a downwadly directed groove positioned adjacent the edge for engaging and partially folding down the upwardly directed side flanges of the carton, said downwardly directed groove being operable to engage and trap an upwardly directed edge of said flanges; and second folding means for contacting and completing the folding down of said flanges, said second folding means being further operable to engage and prebreak the leading end and trailing end flanges.

3. A folding apparatus according to claim 1, wherein said first folding means includes a pair of prebreaking idler rollers, said idler rollers having a peripheral surface provided with said grooved trap and inclined edge.

4. A folding apparatus according to claim 3, wherein said inclined edge surface is inwardly tapered, said grooved trap being positioned inwardly adjacent the inner edge, said inclined edge dimensioned to tangentially contact said flanges and a fold line between the flanges and adjacent carton sides for prebreaking said flanges.

5. A folding apparatus according to claim 4, wherein said second folding means includes a pair of driven rollers having a peripheral edge surface in alignment with the prebreaking idler rollers, said peripheral edge surface transversely dimensioned to contact the side flanges and leading end and trailing end flanges.

6. A folding apparatus according to claim 5, wherein said driven rollers are positioned downstream in tandem arrangement with the prebreaking idler rollers.

7. A folding apparatus according to claim 6, wherein said driven rollers are driven at a tangential rate of speed greater than the velocity of said cartons.

8. A folding apparatus according to claim 7, wherein said driven rollers further include a notch for prebreaking the trailing end flange.

9. A folding apparatus according to claim 8, said notch being sector shaped and having a forwardly directed trailing edge, said driven rollers being timed with the passage of the trailing end flange in a manner enabling said flange to enter the notch and allow the trailing edge to engage and prebreak said flange by moving forwardly and downwardly relative to said flange.

10. A folding apparatus according to claim 1, further comprising side guide rails spaced apart from each other for restraining outward bowing movement of the carton side walls during folding.

11. A folding apparatus according to claim 10, further comprising a pair of inwardly tapered wings located forwardly of the prebreaking idler rollers and being operable to contact the carton sides and thereby align the lateral flanges with said prebreaking idler rollers and further restrain outward bowing.

12. A method of prebreaking and folding relatively short vertical flanges formed on the upper edge of a carton, comprising the steps of conveying the cartons along a predetermined guide path with the flanges positioned in an upwardly directed manner so as to define a pair of side flanges, a trailing end flange and a leading end flange; prebreaking the side flanges with a pair of idler rollers having a grooved trap and inclined edge surface engaging said flanges; folding the side flanges with a pair of driven rollers positioned in tandem arrangement with the idler rollers, engaging and folding the leading end flange by said driven rollers, and engaging and folding the trailing end flange by a notch in said rollers.

* * * * *